US005152493A

United States Patent [19]

Giles

[11] Patent Number: 5,152,493

[45] Date of Patent: Oct. 6, 1992

[54] PLATE HOLDER FOR AN OVERGROUND DISPLAY

[76] Inventor: Trevor P. H. Giles, 343 Olivier Ave., Westmount, Québec, Canada, H2Z 2C8

[21] Appl. No.: 814,443

[22] Filed: Dec. 30, 1991

[51] Int. Cl.[5] ..... A47G 1/16

[52] U.S. Cl. ..... 248/490

[58] Field of Search ..... 248/490, 488, 491, 682, 248/912; 211/41

[56] References Cited

U.S. PATENT DOCUMENTS

| | | | |
|---|---|---|---|
| 2,315,268 | 3/1943 | Oliphant | 248/490 |
| 2,826,384 | 3/1958 | Brown | 248/491 |
| 4,739,961 | 4/1988 | Thomas | 248/490 |

*Primary Examiner*—Alvin C. Chin-Shue
*Attorney, Agent, or Firm*—Robic

[57] ABSTRACT

A plate holder for hanging a plate to a wall for display, comprising a spiderweb-like net and hooks to attach the plate to the net. The net is preferably made of peripheral threads positioned to form a plurality of concentric circles equally spaced and linked together with a set of radial threads positioned in pairs. The net is placed behind the plate and the hooks are positioned to simultaneously engage the plate lip and one of the concentric circles according to size of plate. For a better fitting, the hooks are provided with two snapping recesses, located at different positions on the hooks, for grabbing the net. For smaller plates, the external circles on the net can be cut off. The hooks are made of a material that is not likely to scratch the plates, such as nylon. The plate holder is then fixed to the display site, such as a wall, by a means, such as a conventional painting hook, grabbing one of the threads of the net. This plate holder provides a very reliable means for mounting a plate without damaging it. This plate holder also permits viewing identifications marks on the back of the plates without having to remove it and is adaptable to a multitude of plate sizes.

17 Claims, 2 Drawing Sheets

PLATE HOLDER FOR AN OVERGROUND DISPLAY

FIELD OF THE INVENTION

The present invention relates to a plate holder used to hang or otherwise fix a plate to a wall for display.

The plates that may be fixed as such are antique or decorative plates, such as fine china, that collectors or decorators display. Those plates are usually hung on a wall. Since those plates are usually not provided with a hole or a hook to fix them directly on the wall, a method needs to be provided to hold the plates vertically without damaging those works of art.

DESCRIPTION OF PRIOR ART

Plate holders presently available comprise four metal hooks that are connected to each other by a set of springs that are so assembled as to keep the hooks resiliently engaged onto the periphery of the plate. A metal tab usually completes this basic structure to make it easily attachable onto a metal hook fixed to the wall. A major problem with this kind of holder is that their metal hooks may irreversibly damage the edge of the plate, especially when the plate is made of fine china. Since the holder has to be adapted to a multitude of plate sizes, the springs may not be at the optimum tension The plate can then be damaged by a too high tension or fall if the springs are too slack. Example of such devices are disclosed in U.S. Pat. Nos. 4,542,875 and 4,542,876.

Another conventional plate holder consists of an adhesive pad of leather-like material that may be glued onto the back center area of the plate. The pad may have a tab to attach it to a hook fixed to the wall. This pad holder however hides the identification mark that is usually on the back center area of the plate, thereby making it necessary to cut an opening into the pad. Moreover, a glued pad is an intolerable alteration to an expensive or very fine plate and cannot be used on every plate. The glue may even become ineffective and make the plate fall.

SUMMARY OF THE INVENTION

The object of the present invention is to provide a plate holder to hang a plate over the ground in the vertical position without damaging it, which holder is both reliable and simple.

More particularly, the invention provides a plate holder for mounting a plate to an altitude suitable for display, the plate holder comprising:

a net having a spiderweb-like shape, said net being formed of peripheral thread positioned to form a plurality of concentric circles that are linked together by means of radial threads; and a set of at least three hooks made in a material that is not likely to scratch the plate, each hook having at least one and preferably two snapping recesses, each snapping recess being shaped to be snapped to one of the concentric circles of the net, each hook also having a hooking portion shaped to be hooked to the peripheral edge of the plate.

In use, the plate holder is centrally positioned behind the plate and the hooks are positioned and adjusted to engage the peripheral edge of the plate and one of the concentric circles of the net, thereby making it possible for the same plate holder to be adjusted to a plurality of plate sizes and maintaining the plate vertically.

The net is preferably made of plastic material and more preferably of transparent plastic material. The material is preferably vinyl.

The net may be made of a material that can be easily cut in order to remove unwanted circles and thus to adapt the plate holder to a smaller plate.

The concentric circles of the net are preferably equally spaced. The radial threads may be positioned in pairs, the threads of each pair extending parallel. All these pairs of radial threads may be spaced equally all around the net.

The threads and the radial threads preferably have a circular cross section.

The hooks preferably have two adjacent snapping recesses to be snapped to the net, thereby increasing the possibility of adjustment of the holder. For this purpose, the distance between the two snapping recesses is about one half of the average distance between two adjacent concentric circles.

The hooks are also preferably positioned between the parallel radial threads of pairs of radial threads. For minimizing the visual disturbance of the plate holder, the hooks are preferably made of a transparent plastic material. The hooks are preferably made of Nylon ®.

The number of hooks is preferably three to six, depending on plate size, positioned equidistant around the periphery of the plate.

A non restrictive description of a preferred embodiment will now be given with reference to the appended drawings.

DESCRIPTION OF A PREFERRED EMBODIMENT

Figure 1:
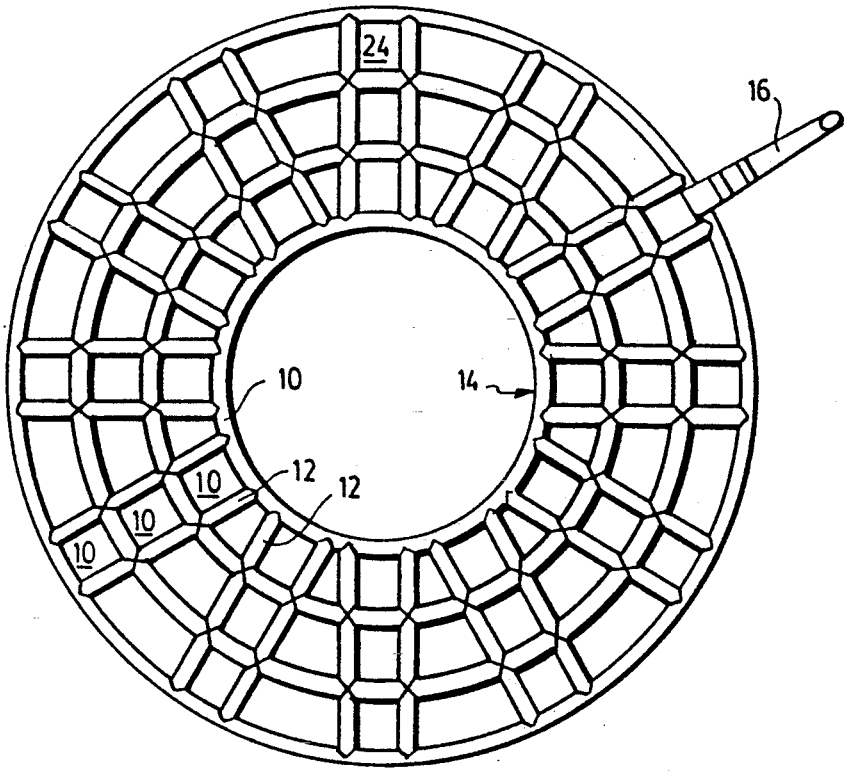
FIG. 1 is a front elevational view of the net and of one of the hooks of a plate holder according to the invention.
Figure 2:
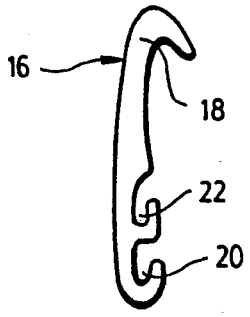
FIG. 2 is a side elevational view of a hook.

The plate holder according to the invention as shown in the drawings comprises a spiderweb-like shaped net 14 comprising a plurality of concentric circles 10 made of peripheral threads. These threads are preferably made of transparent vinyl. The concentric circles 10, preferably equally spaced, are linked together by means of radial threads 12 made of the same material as the concentric circles 10. The concentric circles 10 and the radial threads 12 together form the spiderweb-like shaped net 14. The radial threads 12 are preferably placed by pairs of parallel threads 12. All the threads of the net 14 preferably have a circular section.

The plate holder also comprises hooks 16 made in a material that is not likely to scratch the plates, such as Nylon ®. The hooks 16 have a hook portion 18 and at least one snapping recess 20. The hooking portion 18 is shaped to hook the plate peripheral edge and thus to support the plate. The snapping recess 20 is used to grab a peripheral thread of the net 14. The use of a snapping recess is very convenient because it allows the hooks 16 once attached to the net 14 to be held at all times.

At least three hooks 16 (at most six) are used to support the plate, three being the minimum number of supports according to the principles of statics. Additional hooks 16 may be required depending on the shape and size of the plate. The hooks 16, once fixed to the plate, grab one of the concentric circles 10 which is the closest to the snapping recess 20 according to the size of the plate as it can be seen on FIG. 1. For a better fit and to allow for some elasticity and tension in the net, an additional snapping recess 22 can be provided on the hooks 16 between the hooking portions 18 and the snapping recess 20. The distance between the snapping recess 20 and the additional snapping recess 22 is advantageously about one half of the average distance between two adjacent concentric circles. For example, if the concentric circles are equally spaced and the distance between two adjacent concentric circles is 15 mm, the distance between the two recesses may be 7 mm. This provides for a better adjustment for any size of plate, thus reducing the number of required concentric circles to do the same. Preferably, each hook 16 is snapped onto the net 14 between the threads of a pair of parallel radial threads.

For small plates, the net 14 may be cut to remove any unwanted external concentric circles 10.

Figure 3:
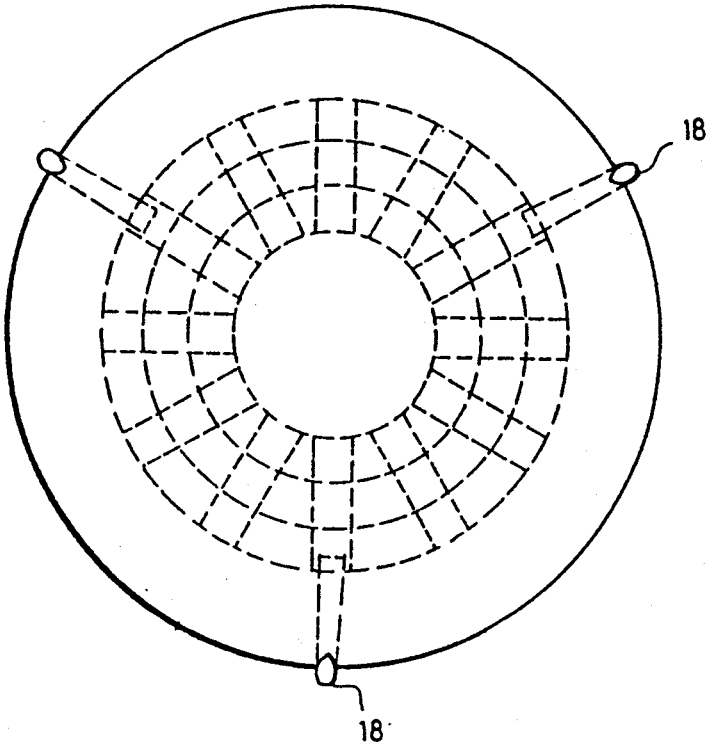
FIG. 3 a front elevational view showing how the invention holds the plate.
Figure 4:
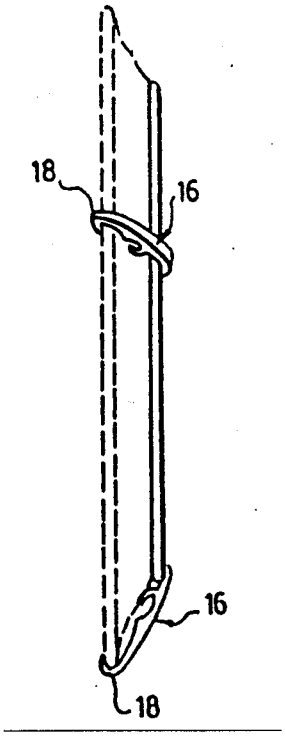

In use, the hooks 16 are positioned in a way to avoid the plate to slip between them. An equidistant positioning of the hooks 16 is a preferable method of accomplishing this. FIG. 3 shows an equidistant positioning of three hooks.

The plate with the plate holder is then fixed to the wall by means of a conventional painting hook (not shown) that grabs one of the radial threads in the upper portion of the net (this also allows for vertical adjustment of the plate on the wall to four heights).

The embodiments of the invention in which an exclusive property or privilege is claimed are defined as follows:

1. A plate holder for use to hang a plate to a wall for display, said plate holder comprising:

a net having a spiderweb-like shape, said net being formed of peripheral threads shaped in a plurality of concentric circles and linked together with a set of radial threads;

a set of at least three hooks made in a material that is not likely to scratch said plate, each hook having a plate hooking portion shaped to be hooked to a plate peripheral edge, and a snapping recess shaped to be snapped to one of said concentric circles of said net; whereby said plate holder is centrally positioned behind said plate and is adjustable to a plurality of plate sizes.

2. The plate holder of claim 1, wherein said net is made of plastic material.

3. The plate holder of claim 2, wherein said net is made of transparent vinyl.

4. The plate holder of claim 1, wherein said net is made of a material that can easily be cut to allow removal of unwanted circles and adapt said plate holder to a smaller plate.

5. The plate holder of claim 1, wherein said concentric circles of said net are equally spaced.

6. The plate holder of claim 1, wherein said radial threads are positioned in pairs, the radial threads of each pair extending parallel to each other.

7. The plate holder of claim 6, wherein said thread pairs are equally spaced around the net.

8. The plate holder of claim 1, wherein said threads of said concentric circles and said radial threads have a circular cross section.

9. The plate holder of claim 1, wherein each hook further comprises an additional snapping recess to be snapped to said net.

10. The plate holder of claim 9, wherein the distance between said snapping recess and said additional snapping recess is about one half of the average distance between two adjacent concentric circles.

11. The plate holder of claim 1, wherein each hook further comprises an additional snapping recess to be snapped to said net.

12. The plate holder of claim 9, wherein the distance between said snapping recess and said additional snapping recess is about one half of the distance between two adjacent concentric circles.

13. The plate holder of claim 6, wherein said hooks are hooked to said net between the parallel radial threads of some of said pairs of radial threads.

14. The plate holder of claim 1, wherein said hooks are made of transparent plastic material.

15. The plate holder of claim 11, wherein said hooks are made of Nylon.

16. The plate holder of claim 1, wherein said hooks are equidistant around said plate.

17. A plate holder for use to hang a plate to a wall for display, said plate holder comprising:

a net having a spiderweb-like shape, said net being formed of peripheral vinyl threads shaped in a plurality of equally spaced concentric circles and linked together with a set of radial threads positioned in pairs, the radial vinyl threads of each pair extending parallel to each other;

a set of three Nylon hooks, each hook having a plate hooking portion shaped to be hooked to a plate peripheral edge, and two snapping recesses shaped to be snapped to one of said concentric circles of said net between the parallel radial threads of some of said pairs of threads, the distance between said two snapping recesses being about one half of the distance between two adjacent concentric circles;

whereby said plate holder is centrally positioned behind said plate and is adjustable to a plurality of plate sizes.

* * * * *

UNITED STATES PATENT AND TRADEMARK OFFICE

CERTIFICATE OF CORRECTION

PATENT NO. : 5,152,493

DATED : October 6, 1992

INVENTOR(S) : Trevor P.H. GILES

It is certified that error appears in the above-identified patent and that said Letters Patent is hereby corrected as shown below:

On the Title page:

In Box 76, the zip code of the inventor should read --H3Z 2C8--.

Signed and Sealed this

Second Day of November, 1993

Attest:

Bruce Lehman

BRUCE LEHMAN

Attesting Officer

Commissioner of Patents and Trademarks